US009359797B2

(12) United States Patent
Shen

(10) Patent No.: US 9,359,797 B2
(45) Date of Patent: Jun. 7, 2016

(54) PUSH/PULL OPERATING DEVICE FOR DRIVING A LATCH DEVICE

(71) Applicant: I-TEK METAL MFG. CO., LTD., Tainan (TW)

(72) Inventor: Jimmy Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 351 days.

(21) Appl. No.: 14/156,500

(22) Filed: Jan. 16, 2014

(65) Prior Publication Data

US 2015/0197968 A1 Jul. 16, 2015

(51) Int. Cl.
*E05C 1/14* (2006.01)
*E05B 63/04* (2006.01)
*E05B 9/08* (2006.01)

(52) U.S. Cl.
CPC ... *E05C 1/14* (2013.01); *E05B 9/08* (2013.01); *E05B 63/04* (2013.01); *Y10T 292/096* (2015.04)

(58) Field of Classification Search
CPC ..... E05C 1/14; E05B 9/08; E05B 63/04; Y10T 292/096; Y10S 292/60
USPC ..... 292/92–94, 336.6
See application file for complete search history.

(56) References Cited

U.S. PATENT DOCUMENTS 1,194,636 A * 8/1916 Joy ..... E05B 17/08 292/137
5,072,977 A * 12/1991 Millman ..... E05B 63/04 292/172
5,083,822 A * 1/1992 Mangin ..... E05B 65/1066 292/21
5,085,474 A * 2/1992 Toledo ..... E05C 1/14 292/244
5,403,047 A * 4/1995 Walls ..... E05B 63/0069 292/173
5,609,372 A * 3/1997 Ponelle ..... E05B 3/04 292/200
5,730,478 A * 3/1998 D'Hooge ..... E05B 7/00 292/165
6,196,599 B1 * 3/2001 D'Hooge ..... E05B 7/00 292/165
6,293,598 B1 * 9/2001 Rusiana ..... E05B 7/00 292/143
7,258,374 B2 * 8/2007 Rusiana ..... E05C 1/14 292/244
9,039,051 B2 * 5/2015 Shen ..... E05B 7/00 292/336.3
2008/0116699 A1 * 5/2008 Karcher ..... E05B 3/06 292/336.3
2012/0073084 A1 * 3/2012 Lin ..... E05B 3/00 16/412
2013/0076046 A1 * 3/2013 Shah ..... E05B 63/0056 292/336.3

* cited by examiner

*Primary Examiner* — Andrew Roersma
(74) *Attorney, Agent, or Firm* — Alex D. Kamrath; Kamrath IP Lawfirm, P.A.

(57) ABSTRACT

A push/pull operating device includes first and second operational devices mounted to two sides of a door. The first operational device includes a first bracket having two slots. A fixing plate is pivotably mounted to the first bracket. Two engaging rods extend through the slots of the first bracket. The fixing plate can be pivoted to a position where through-holes in a latch device and through-holes are aligned with the engaging rods. Thus, the push/pull operating device can be used with differently handed doors and different latch devices having different through-hole locations.

3 Claims, 16 Drawing Sheets

PUSH/PULL OPERATING DEVICE FOR DRIVING A LATCH DEVICE

BACKGROUND OF THE INVENTION

The present invention relates to a push/pull operating device and, more particularly, to a push/pull operating device for retracting a latch by pushing or pulling a handle.

A type of push/pull operating device for driving a latch includes a handle that can be pushed or pulled to retract a latch of a latch device in a door and is generally used in hospitals. Specifically, a medical worker can open the door by pushing or pulling the handle with his or her arm to avoid his or her hands from being contaminated by bacteria or germs left on the handle, preventing his or her patients from contamination. The push/pull operating device includes first and second operational devices respectively mounted to two sides of the door. The latch device is mounted in a compartment of the door and includes through-holes for installing the first and second operational devices. Since the through-holes of latch devices produced by different manufacturers have different locations, a mounting board with a plurality of fixing holes is provided to each side of the door, with two of the fixing holes of each mounting board aligned with the through-holes of the latch device mounted in the door. A fastener is mounted in each fixing hole of one of the mounting boards aligned with a corresponding through-hole of the latch device. A screw is extended through each of associated fixing holes in the other mounting board and engages with one of the fasteners. Thus, the mounting boards are fixed to two sides of the door. Then, the first and second operational devices are mounted to the mounting boards. To allow on-site installation depending upon different handing of the door or different through-hole locations in the lock case, either the first operational device or the second operational device must be completely detached so that the fasteners can be inserted into the through-holes at different locations according to the handing of the door. Then, the detached first or second operational device is mounted and fixed by screws and fasteners. The installation is complicated and inconvenient.

Thus, a need exists for a novel push/pull operating device allowing easy installation.

BRIEF SUMMARY OF THE INVENTION

The present invention solves this need and other problems in the field of easy installation by providing a push/pull operating device for driving a latch device. The push/pull operating device includes a first bracket having first and second surfaces. The first bracket further includes a pivot hole extending from the first surface through the second surface of the first bracket. The first bracket further includes two slots. The pivot hole of the first bracket is located between the slots. Each slot includes a first end and a second end. The first bracket further includes two lateral sides extending between the first and second surfaces of the first bracket. The first bracket further includes a wing formed on each of the lateral sides of the first bracket. Each wing of the first bracket includes an engagement hole. The first bracket is adapted to be mounted to a first side of a door. The pivot hole of the first bracket is adapted to align with a first through-hole in the first side of the door. The first ends or the second ends of the slots of the first bracket are adapted to align with two second through-holes in the first side of the door.

A first transmission member includes a pivotal portion pivotably received in the pivot hole of the first bracket. The first transmission member further includes a flange on an end of the pivotal portion of the first transmission member. A protrusion is formed on the flange of the first transmission member. A driving hole extends from an end face of the flange through an end face of the other end of the pivotal portion of the first transmission member. The flange of the first transmission member is located outside of the first surface of the first bracket. The pivotal portion of the first transmission member is adapted to be received in the first through-hole in the first side of the door.

A fixing plate is pivotably connected to the first transmission member. The fixing plate includes a first side and a second side opposite to the first side. The fixing plate further includes a through-hole extending from the first side through the second side. The fixing plate further includes two engagement holes spaced from the through-hole of the fixing plate and aligned with the slots. The pivotal portion of the first transmission member is pivotably received in the through-hole of the fixing plate. The fixing plate is located between the first surface of the first bracket and the flange of the first transmission member.

A first spindle has first and second ends. The first end of the first spindle is engaged in the driving hole of the first transmission member. The first spindle and the first transmission member are jointly pivotable. The second end of the first spindle are adapted to extend through the first through-hole of the door and are adapted to be coupled to a follower of a latch device mounted in the door. The latch device includes a latch operatively coupled to the follower and movable between a latching position outside the door and an unlatching position inside the door.

A first axle is pivotably received in the engagement holes of the wings of the first bracket. A first handle is pivotably connected to the first axle. The first handle includes a base and an arm extending from the base. The first handle is pivotable about a pivot axis defined by the first axle between a release position and a pressing position.

A first actuating block is detachably mounted to the base of the first handle. The first actuating block abuts the protrusion of the first transmission member. The first actuating block presses against and pivots the first transmission member when the first handle pivots from the release position to the pressing position.

A second bracket includes first and second surfaces. The second bracket further includes a pivot hole extending from the first surface through the second surface of the second bracket. The second bracket further includes two first holes and two second holes around the pivot hole of the second bracket. The first holes are diametrically opposed to each other in a diameter direction of the pivot hole of the second bracket. The second holes are diametrically opposed to each other in a diameter direction of the pivot hole of the second bracket. The second bracket further includes two lateral sides extending between the first and second surfaces of the second bracket. The second bracket further includes a wing formed on each lateral side of the second bracket. Each wing of the second bracket includes an engagement hole. The second bracket is adapted to be mounted to a second side of the door opposite to the first side of the door. The pivot hole of the second bracket is adapted to align with a third through-hole in the second side of the door. Each first hole or each second hole of the second bracket is adapted to align with one of two fourth through-holes in the second side of the door. The fourth through-holes of the door are adapted to align with two through-holes of the latch device.

A second transmission member includes a pivotal portion pivotably received in the pivot hole of the second bracket. The second transmission member further includes a flange on an end of the pivotal portion of the second transmission member. A protrusion is formed on the flange of the second transmission member. A driving hole extends from an end face of the flange through an end face of the other end of the pivotal portion of the second transmission member. The flange of the second transmission member is located outside of the first surface of the second bracket. The pivotal portion of the second transmission member is adapted to be received in the third through-hole in the second side of the door.

A second spindle has first and second ends. The first end of the second spindle is engaged in the driving hole of the second transmission member. The second spindle and the second transmission member are jointly pivotable. The second end of the second spindle is adapted to extend through the third through-hole of the door and is adapted to be coupled to the follower of the latch device.

A second axle is pivotably received in the engagement holes of the wings of the second bracket. A second handle is pivotably mounted to the second axle. The second handle includes a base and an arm extending from the base of the second handle. The second handle is pivotable about a pivot axis defined by the second axle between a release position and a pressing position.

A second actuating block is detachably mounted to the base of the second handle. The second actuating block abuts the protrusion of the second transmission member. The second actuating block presses against and pivoting the second transmission member when the second handle pivots from the release position to the pressing position.

Two engaging rods are provided. Each engaging rod is securely positioned and non-rotatably engaged in one of the engagement holes of the fixing plate. Each engaging rod includes a body extending through one of the slots of the first bracket. When the fixing plate pivots, each engaging rod moves between the first and second ends of one of the slots of the first bracket. When each engaging rod is aligned with the first end or the second end of one of the slots of the first bracket, the bodies of the engaging rods are adapted to extend through the two second through-holes in the first side of the door and are adapted to extend through the through-holes of the latch device.

Two bolts are engaged with the engaging rods. Each bolt includes a head abutting the first surface of the second bracket. The two bolts extending through the first holes or the second holes of the second bracket. The bolts are adapted to extend through the fourth through-holes in the second side of the door and the through-holes of the latch device to engage with the engaging rods.

When each engaging rod is in the first end of one of the slots of the first bracket, each engaging rod is aligned with one of the first holes of the second bracket. When each engaging rod is in the second end of one of the slots of the first bracket, each engaging rod is aligned with one of the second holes of the second bracket.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
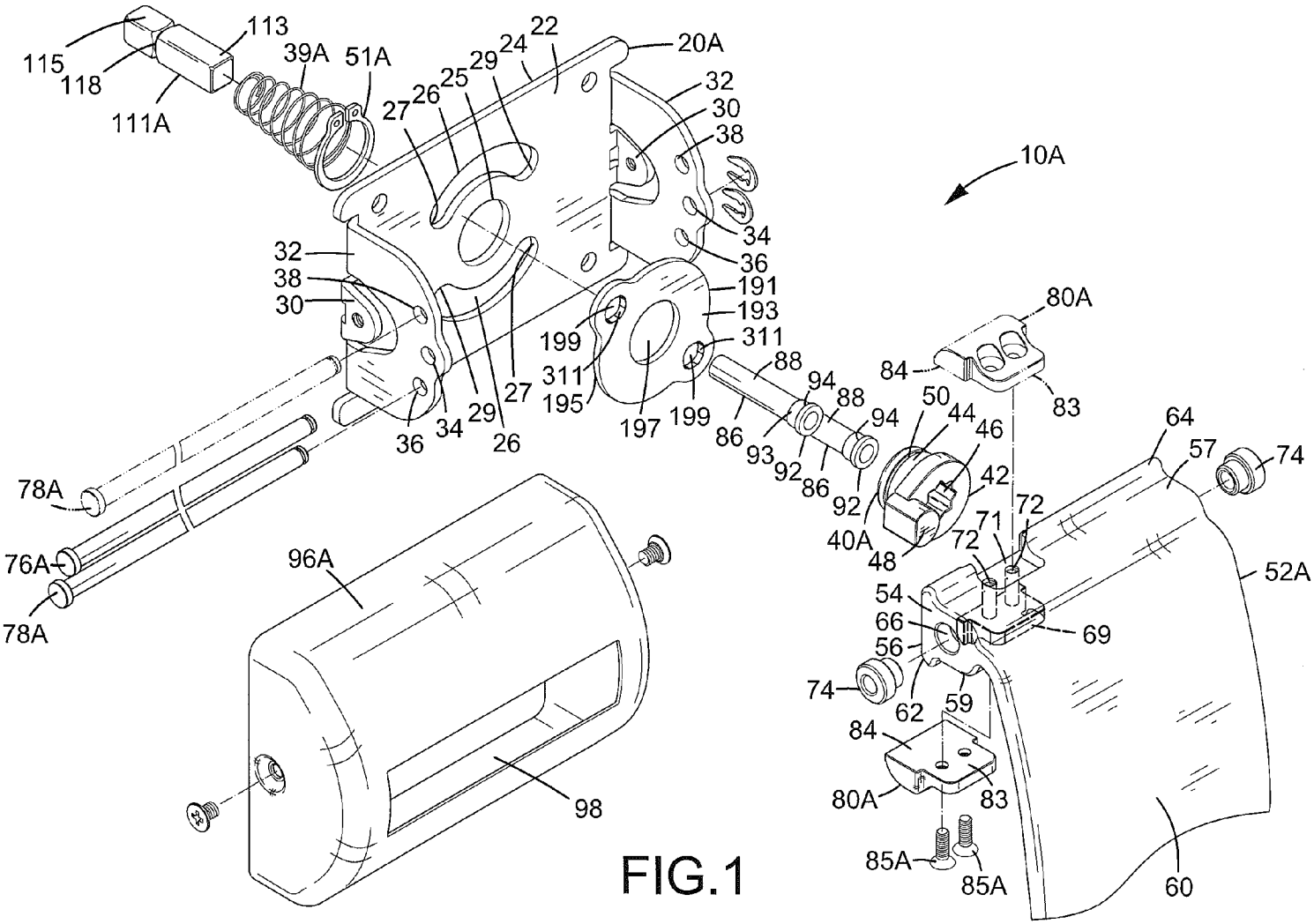
FIG. 1 is an exploded, perspective view of a first operational device of a push/pull operating device according to the present invention.
Figure 2:
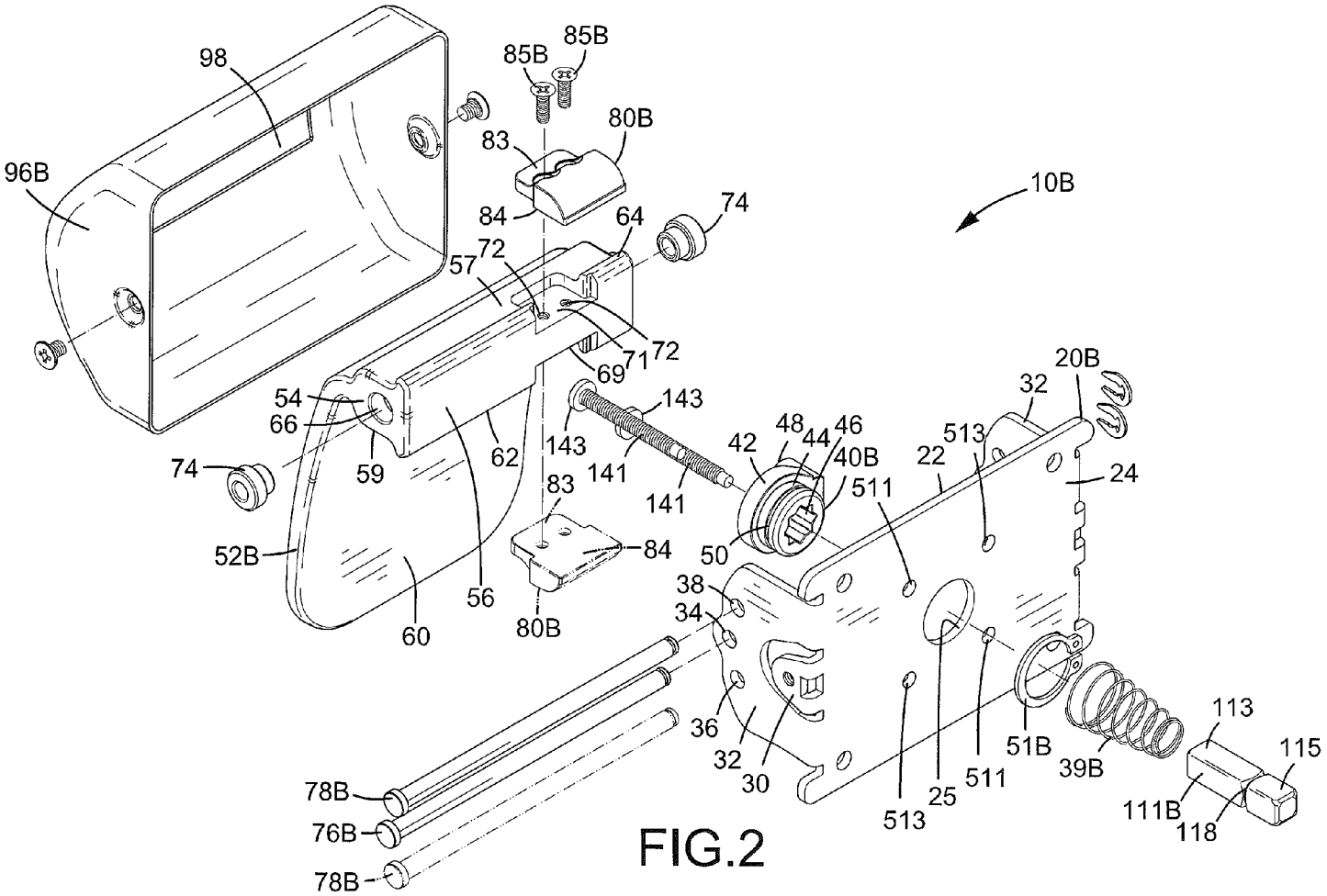
FIG. 2 is an exploded, perspective view of a second operational device of the push/pull operating device according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "inner", "outer", "lower", "upper", "side", "end", "portion", "section", "vertical", "circumferential", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to the drawings, a push/pull operating device according to the present invention is mounted to a door 116 having a first side 117, a second side 119 opposite to first side 117, and an end face 131 extending between first and second sides 117 and 119. In the embodiment shown in FIG. 3, first side 117 faces an outer side of door 116, and second side 119 faces an inner side of door 116. Door 116 further includes a compartment 133 between first and second sides 117 and 119 and spaced from end face 131. Door 116 further includes a first through-hole 135A and two second through-holes 137A, with each of first and second through-holes 135A and 137A extending from first side 117 to compartment 133, and with first through-hole 135A located between second through-holes 137A. Door 116 further includes a third through-hole 135B and two fourth through-holes 137B, with each of third and fourth through-holes 135B and 137B extending from second side 119 to compartment 133, with third through-hole 135B located between fourth through-holes 137B, with first through-hole 135A aligned with third through-hole 135B, and with each second through-hole 137A aligned with one of fourth through-holes 137B.

Figure 4:
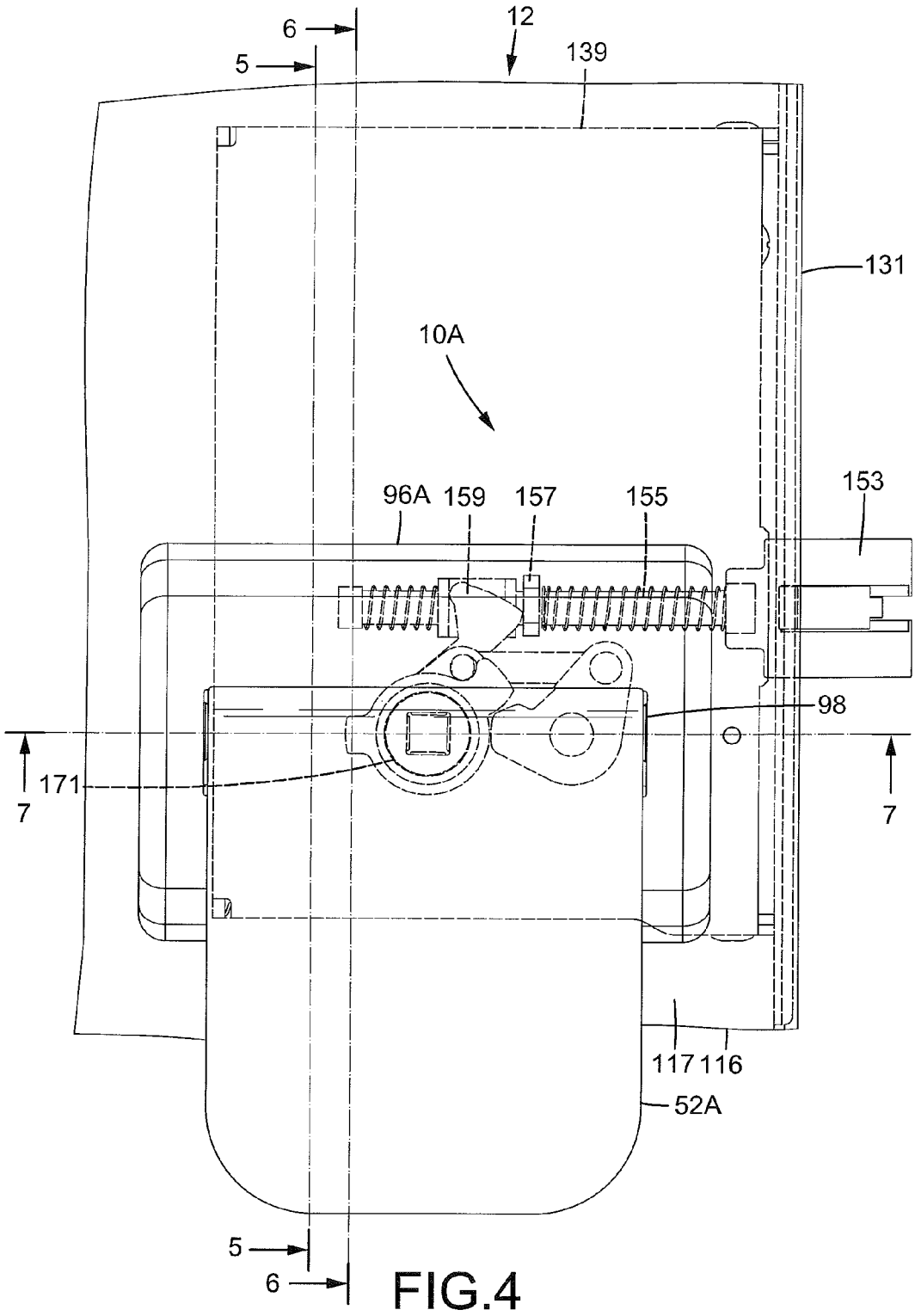
FIG. 4 is a partial, side view of the door and the push/pull operating device of FIG. 3.
Figure 11:
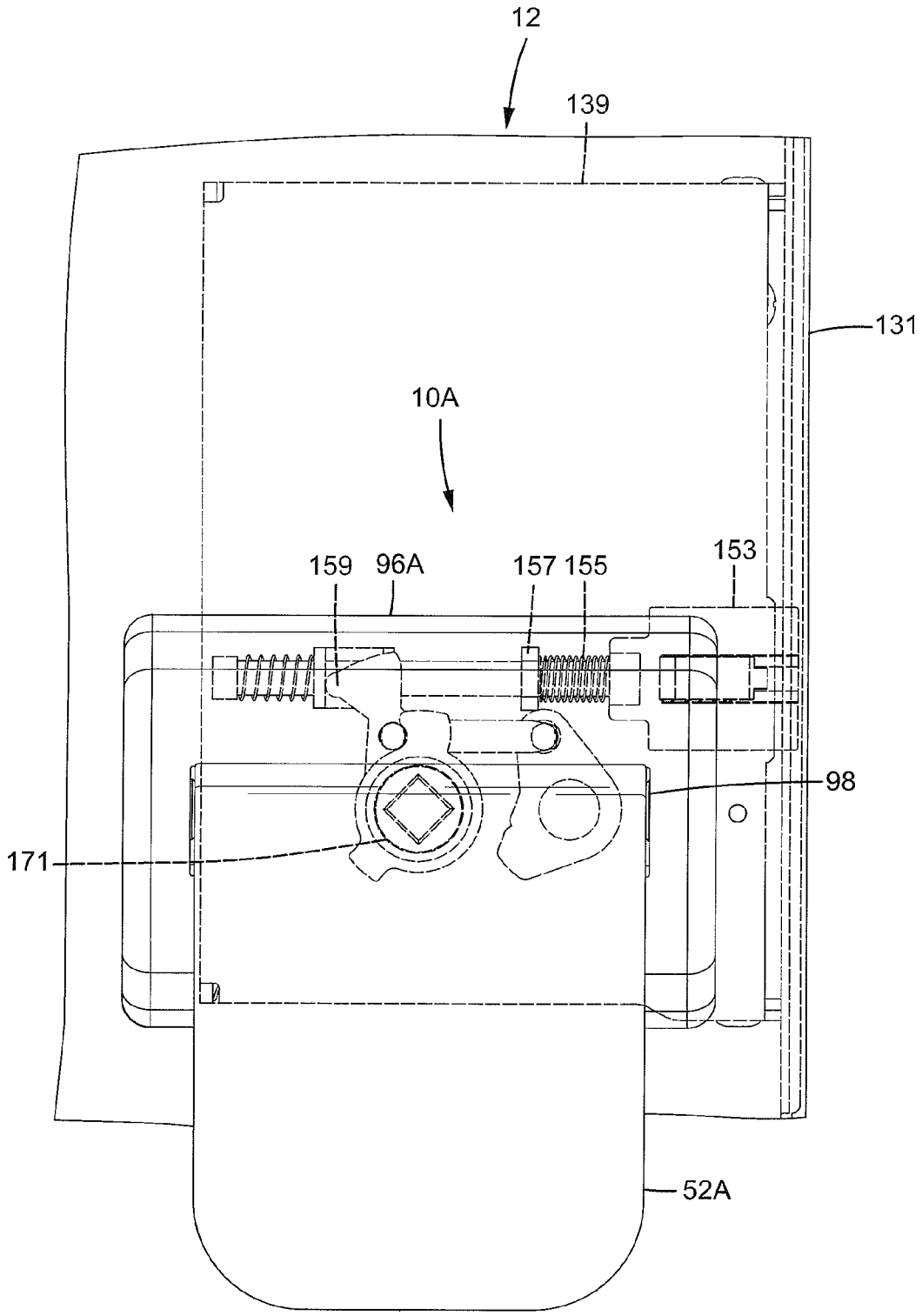
FIG. 11 shows a view similar to FIG. 4, with the first handle or the second handle pivoted to the pressing position, and with a latch of the latch device retracted.
Figure 12:
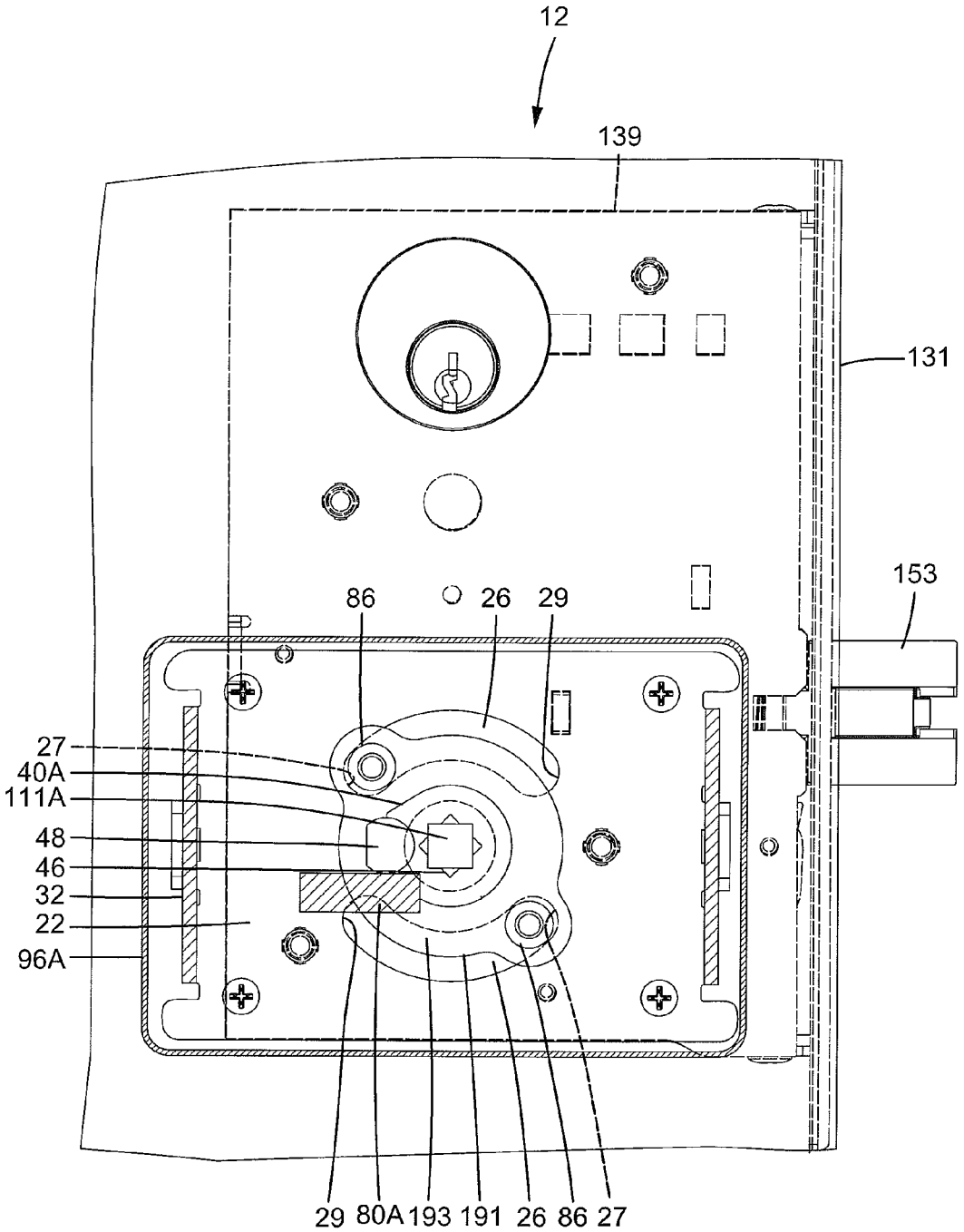
FIG. 12 is a cross sectional view taken along section line 12-12 of FIG. 8.

The push/pull operating device includes a first operational device 10A mounted to first side 117 of door 116 and a second operational device 10B mounted to second side 119 of door 116. A latch device 12 is mounted in compartment 133 of door 116. Latch device 12 includes a case 139 having two through-holes 151, with each through-hole 151 aligned with one of second through-holes 137A and one of fourth through-holes 137B. Latch device 12 further includes a latch 153 having a shank 155 received in case 139. An actuation member 157 is coupled to shank 155, allowing joint movement of shank 155 and actuation member 157. A driving board 159 is pivotably mounted in case 139 and jointly moveable with actuation member 157. A follower 171 is coupled to driving board 159 and aligned with first and third through-holes 135A and 135B. Latch 153 is movable between a latching position outside end face 131 of door 116 (FIG. 4) and an unlatching position not extending beyond end face 131 of door 116 (FIG. 11). Latch 153 moves between the latching position and the unlatching position when driving board 159 pivots and causes movement of actuation member 157.

First operational device 10A includes a first bracket 20A having a first surface 22 and a second surface 24 opposite to first surface 22. A pivot hole 25 extends from first surface 22 through second surface 24. First bracket 20A further includes two slots 26, with each slot 26 being arcuate and extending from first surface 22 through second surface 24, and with pivot hole 25 located between slots 26. Each slot 26 has a first end 27 and a second end 29, with first ends 27 of slots 26 diametrically opposed to each other, and with second ends 29 of slots 26 diametrically opposed to each other. First bracket 20A further includes two lateral sides extending between first and second surfaces 22 and 24. A lug 30 is formed on each lateral side of first bracket 20A. A wing 32 is formed on each lateral side of first bracket 20A and around one of lugs 30. Each wing 32 has first and second limiting holes 36 and 38 spaced from each other in a vertical direction and an engagement hole 34 between first and second limiting holes 36 and 38.

First operational device 10A further includes a first transmission member 40A pivotably mounted in pivot hole 25 of first bracket 20A. First transmission member 40A includes a pivotal portion 44 and a flange 42 on an end of pivotal portion 44. An annular groove 50 is formed in an outer periphery of pivotal portion 44 and located adjacent to the other end of pivotal portion 44. A protrusion 48 is formed on flange 42. A driving hole 46 extends from an end face of flange 42 through an end face of the other end of pivotal portion 44. Flange 42 of first transmission member 40A is located outside of first surface 22 of first bracket 20A, and annular groove 50 of first transmission member 40A is located outside of second surface 24 of first bracket 20A. A retaining ring 51A is mounted in annular groove 50 of first transmission member 40A, preventing first transmission member 40A from disengaging from pivot hole 25 of first bracket 20A.

First operational device 10A further includes a fixing plate 191 pivotably connected to first transmission member 40A. Fixing plate 191 includes a first side 193 and a second side 195 opposite to the first side 193. Fixing plate 191 further includes a through-hole 197 extending from first side 193 through second side 195. Fixing plate 191 further includes two engagement holes 199 spaced from through-hole 197. Engagement holes 199 are spaced from each other in a circumferential direction of through-hole 197. A pressing face 311 in the form of a protrusion or recession is formed on an inner periphery of each engagement hole 199. Through-hole 197 of fixing plate 191 pivotably receives pivotal portion 44 of first transmission member 40A, with fixing plate 191 located between first surface 22 of first bracket 20A and flange 42 of first transmission member 40A, with through-hole 197 of fixing plate 191 aligned with pivot hole 25 of first bracket 20A, and with engagement holes 199 respectively aligned with slots 26.

First operational device 10A further includes a first spindle 111A having first and second ends 113 and 115. A groove 118 is formed between first and second ends 113 and 115 of first spindle 111A. An end of a spring 39A is mounted in groove 118 of first spindle 111A. First end 113 of first spindle 111A is engaged in driving hole 46 of first transmission member 40A, allowing joint pivotal movement of first spindle 111A and first transmission member 40A. The other end of spring 39A abuts against pivotal portion 44 of first transmission member 40A.

A first handle 52A is pivotably mounted between wings 32 of first bracket 20A. First handle 52A includes a base 54 and an arm 60 extending from base 54. Base 54 has an upper face 57, a lower face 59 and an inner face 56 extending between upper face 57 and lower face 59. Upper face 57 has an upper protrusion 64 on an edge thereof, lower face 59 has a lower protrusion 62 on an edge thereof, and inner face 56 extends between upper and lower protrusions 64 and 62. First handle 52A further includes an axle hole 66 in base 54 and between upper and lower protrusions 64 and 62. A first positioning groove 69 is formed in lower face 59. A second positioning groove 71 is formed in upper face 57. First handle 52A further includes two fixing holes 72, with each fixing hole 72 extending from a bottom wall of first positioning groove 69 through a bottom wall of second positioning groove 71.

Figure 9:
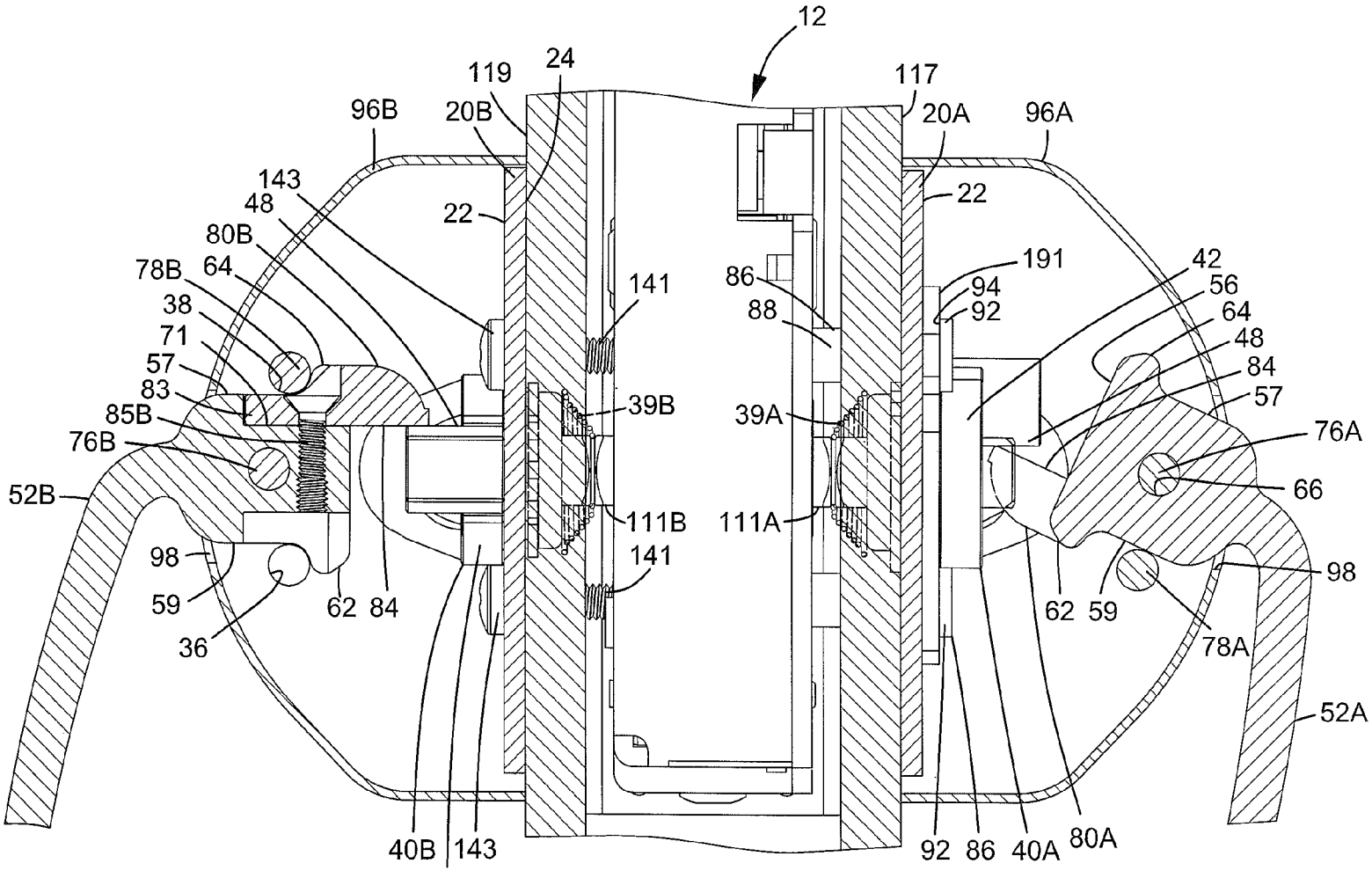
FIG. 9 is a view similar to FIG. 5, with a first handle pivoted to a pressing position.

A sleeve 74 is mounted between each lateral side of first handle 52A and one of wings 32 of first bracket 20A and is pivotably mounted in axle hole 66. A first axle 76A extends through axle hole 66 of first handle 52A, extends through engagement holes 34 of wings 32 of first bracket 20A, and is pivotably engaged with sleeves 74. Thus, first handle 52A is pivotable about a pivot axis defined by first axle 76A between a release position (FIGS. 5 and 6) and a pressing position (FIG. 9).

A first limiting rod 78A extends through first limiting holes 36 of wings 32 of first bracket 20A. When first handle 52A is in the release position, lower face 59 of first handle 52A abuts first limiting rod 78A, and lower protrusion 62 is stopped by first limiting rod 78A, preventing arm 60 of first handle 52A from pivoting away from first surface 22 of first bracket 20A.

First operational device 10A further includes a first actuating block 80A fixed to inner face 56 of first handle 52A. First actuating block 80A includes a positioning portion 83 and a pressing portion 84. Positioning portion 83 of first actuating block 80A is received in first positioning groove 69. Two screws 85A extend through positioning portion 83 of first actuating block 80A into fixing holes 72 of first handle 52A. Pressing portion 84 of first actuating block 80A extends beyond inner face 56 of base 54 of first handle 52A, abuts protrusion 48 of first transmission member 40A, and is located below protrusion 48 in the vertical direction. In this case, first handle 52A is of push-open type. Namely, arm 60 of first handle 52A can be pushed towards first surface 22 of first bracket 20A when it is desired to pivot first handle 52A from the release position to the pressing position.

Second operational device 10B includes a second bracket 20B having a first surface 22 and a second surface 24 opposite to first surface 22. A pivot hole 25 extends from first surface 22 through second surface 24 of second bracket 20B. Two first holes 511 and two second holes 513 are provided around pivot hole 25 of second bracket 20B and are spaced from each other in a circumferential direction about an axis of pivot hole 25 of second bracket 20B. First holes 511 are diametrically opposed to each other in a diameter direction of pivot hole 25 of second bracket 20B and are respectively aligned with first ends 27 of slots 26 of first bracket 20A. Second holes 513 are diametrically opposed to each other in a diameter direction of pivot hole 25 of second bracket 20B and are respectively aligned with second ends 29 of slots 26 of first bracket 20A. Second bracket 20B further includes two lateral sides extending between first and second surfaces 22 and 24. A lug 30 is formed on each lateral side of second bracket 20B. A wing 32 is formed on each lateral side of second bracket 20B and around one of lugs 30 of second bracket 20B. Each wing 32 of second bracket 20B has first and second limiting holes 36 and 38 spaced from each other in the vertical direction and an engagement hole 34 between first and second limiting holes 36 and 38.

Second operational device 10B further includes a second transmission member 40B pivotably mounted in pivot hole 25 of second bracket 20B. Second transmission member 40B includes a pivotal portion 44 and a flange 42 on an end of pivotal portion 44. An annular groove 50 is formed in an outer periphery of pivotal portion 44 of second transmission member 40B and is located adjacent to the other end of pivotal portion 44 of second transmission member 40B. A protrusion 48 is formed on flange 42 of second transmission member 40B. A driving hole 46 extends from an end face of flange 42 of second transmission member 40B through an end face of the other end of pivotal portion 44 of second transmission member 40B. Flange 42 of second transmission member 40B is located outside of first surface 22 of second bracket 20B, and annular groove 50 of second transmission member 40B is located outside of second surface 24 of second bracket 20B. A retaining ring 51B is mounted in annular groove 50 of second transmission member 40B, preventing second transmission member 40B from disengaging from pivot hole 25 of second bracket 20B.

Second operational device 10B further includes a second spindle 111B having first and second ends 113 and 115. A groove 118 is formed between first and second ends 113 and 115 of second spindle 111B. An end of a spring 39B is mounted in groove 118 of second spindle 111B. First end 113 of second spindle 111B is engaged in driving hole 46 of second transmission member 40B, allowing joint pivotal movement of second spindle 111B and second transmission member 40B. The other end of spring 39B abuts against pivotal portion 44 of second transmission member 40B.

A second handle 52B is pivotably mounted between wings 32 of second bracket 20B. Second handle 52B includes a base 54 and an arm 60 extending from base 54. Base 54 of second handle 52B has an upper face 57, a lower face 59 and an inner face 56 extending between upper face 57 and lower face 59. Upper face 57 of base 54 of second handle 52B has an upper protrusion 64 on an edge thereof, lower face 59 of base 54 of second handle 52B has a lower protrusion 62 on an edge thereof, and inner face 56 of base 54 of second handle 52B extends between upper and lower protrusions 64 and 62 of second handle 52B. Second handle 52B further includes an axle hole 66 in base 54 and between upper and lower protrusions 64 and 62. A first positioning groove 69 is formed in lower face 59 of second handle 52B. A second positioning groove 71 is formed in upper face 57 of second handle 52B. Second handle 52B further includes two fixing holes 72, with each fixing hole 72 extending from a bottom wall of first positioning groove 69 of second handle 52B through a bottom wall of second positioning groove 71 of second handle 52B.

Figure 10:
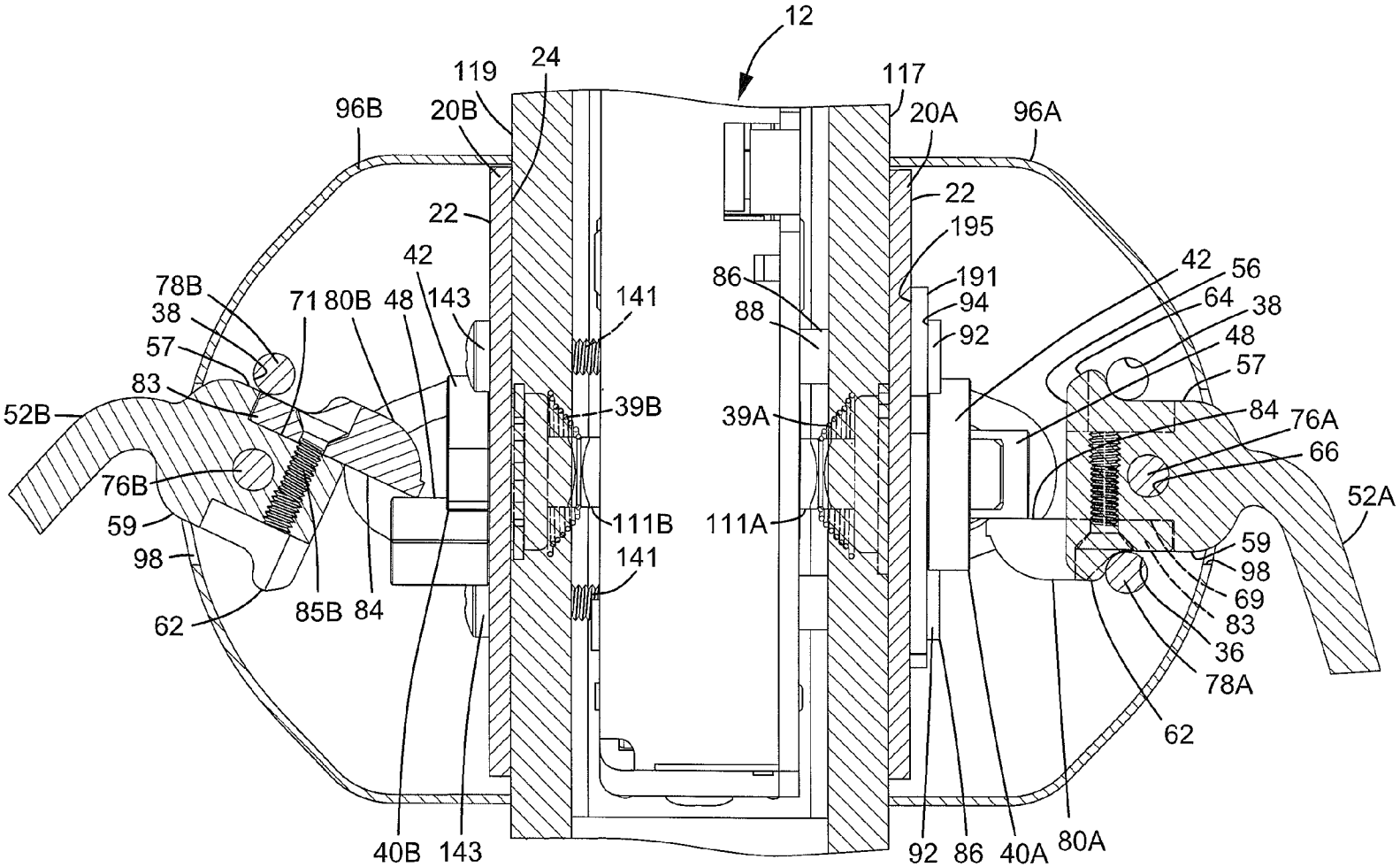
FIG. 10 shows a view similar to FIG. 5, with a second handle pivoted to a pressing position.

A sleeve 74 is mounted between each lateral side of second handle 52B and one of wings 32 of second bracket 20B and is pivotably mounted in axle hole 66 of second handle 52B. A second axle 76B extends through axle hole 66 of second handle 52B, extends through engagement holes 34 of wings 32 of second bracket 20B, and is pivotably engaged with sleeves 74. Thus, second handle 52B is pivotable about a pivot axis defined by second axle 76B between a release position (FIGS. 5 and 6) and a pressing position (FIG. 10).

A second limiting rod 78B extends through second limiting holes 38 of wings 32 of second bracket 20B. When second handle 52B is in the release position, upper face 57 of second handle 52B abuts second limiting rod 78B, and upper protrusion 64 of second handle 52B is stopped by second limiting rod 78B, preventing arm 60 of second handle 52B from pivoting towards first surface 22 of second bracket 20B.

Second operational device 10B further includes a second actuating block 80B fixed to upper protrusion 64 of second handle 52B. Second actuating block 80B includes a positioning portion 83 and a pressing portion 84. Positioning portion 83 of second actuating block 80B is received in second positioning groove 71 of second handle 52B. Two screws 85B extend through positioning portion 83 of second actuating block 80B into fixing holes 72 of second handle 52B. Pressing portion 84 of second actuating block 80B extends beyond inner face 56 of base 54 of second handle 52B, abuts protrusion 48 of second transmission member 40B, and is located above protrusion 48 of second transmission member 40B in the vertical direction. In this case, second handle 52B is of pull-open type. Namely, arm 60 of second handle 52B can be pulled away from first surface 22 of second bracket 20B when it is desired to pivot second handle 52B from the release position (FIG. 5) to the pressing position (FIG. 10).

Figure 8:
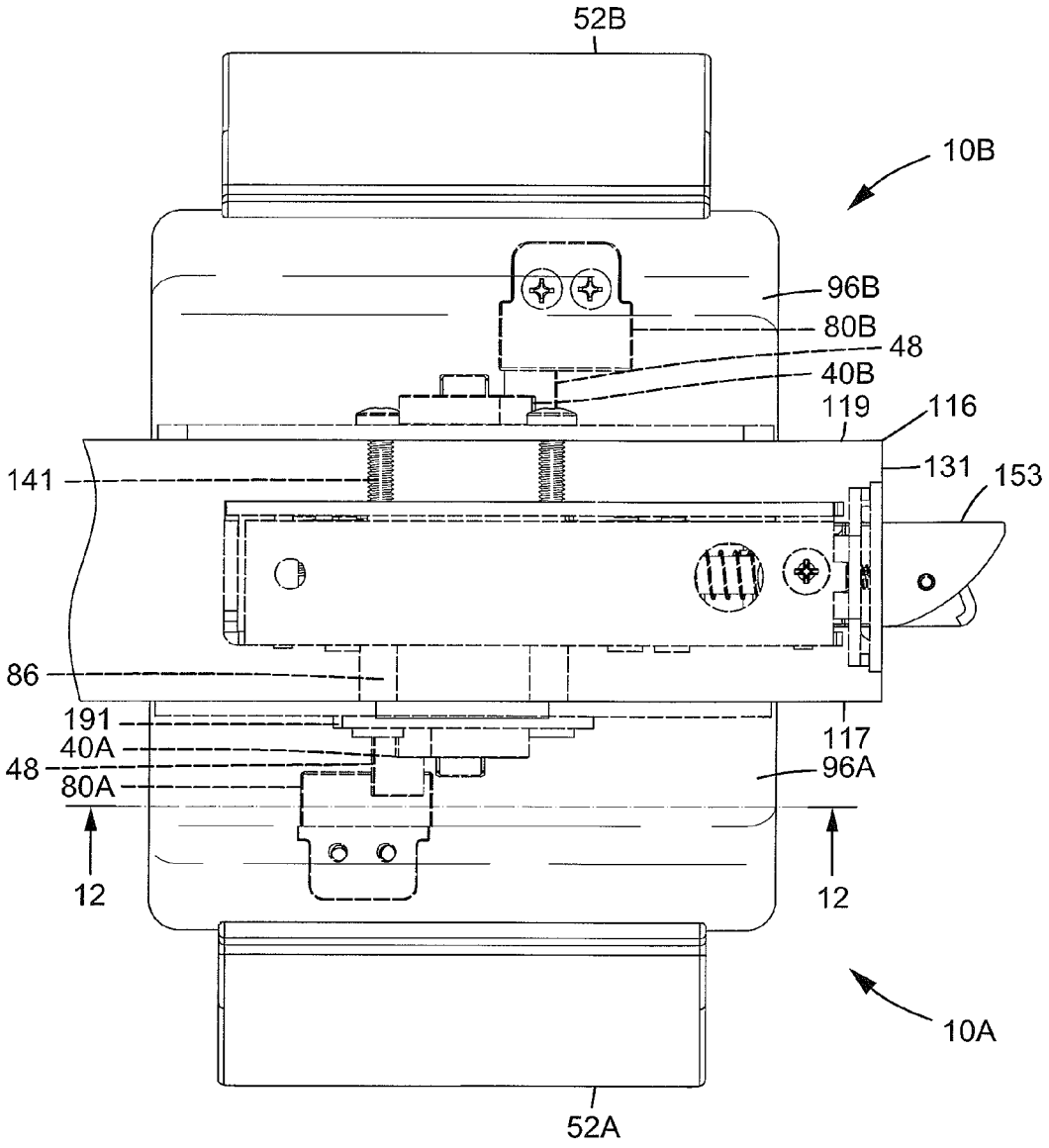
FIG. 8 is a top view of the door, the latch device, and the pull/push operating device of FIG. 3.

Push/pull operating device further includes two engaging rods 86 and two bolts 141. Each engaging rod 86 includes a body 88 and a head 92 having a diameter larger than a diameter of body 88. Each engaging rod 86 has a screw hole in an end opposite to head 92 (FIG. 8). Each engaging rod 86 further includes a fixing portion 93 between body 88 and head 92 and having a diameter smaller than the diameter of head 92, forming an abutment face 94 between an intersection between fixing portion 93 and head 92. Each bolt 141 has a head 143 on a distal end thereof. Fixing portion 93 of each engaging rod 86 is slightly larger than engagement hole 199 of fixing plate 191. Body 88 of each engaging rod 86 extends from first side 193 of fixing plate 191 through one of engagement holes 199. Fixing portion 93 of each engaging rod 86 presses against and is positioned by pressing face 311 of one of engagement holes 199, fixing engaging rods 86 to fixing plate 191. Body 88 of each engaging rod 86 extends from first surface 22 of first bracket 20A into one of slots 26. When fixing plate 191 pivots, each engaging rod 86 pivots jointly with fixing plate 191 and slides between first end 27 and second end 29 of one of slots 26.

Figure 3:
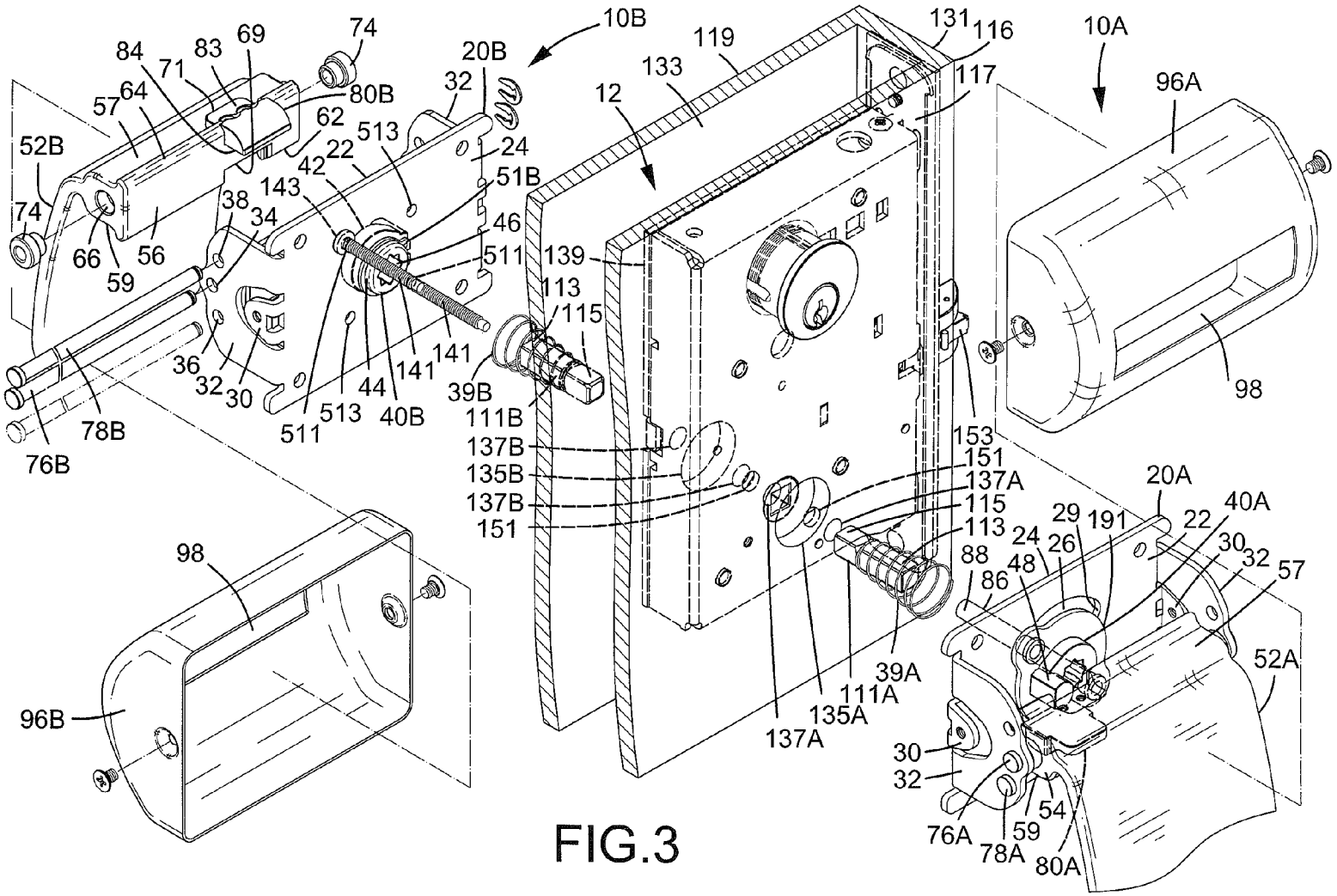
FIG. 3 is an exploded, perspective view of the push/pull operating device, a portion of a door, and a latch device, with a left side of the door adapted to be pivotably connected to a door frame.

With reference to FIGS. 3-12, for the sake of explanation, it will be assumed that the left side of door 116 is pivotably connected to a door frame when viewed from first side 117 of door 116. One of through-holes 151 (the left one in FIG. 3) of latch device 12 is above the other through-hole 151 (the right one in FIG. 3). In assembly of first operational device 10A, fixing plate 191 of first operational device 10A is pivoted until each engaging rod 86 is in first end 27 of one of slots 26. Thus, each engaging rod 86 is aligned with one of second through-holes 137A of door 116, one of fourth-through holes 137B of door 116, and one of through-holes 151 of latch device 12. First bracket 20A of first operational device 10A is then mounted to abut first side 117 of door 116, with body 88 of each engaging rod 86 extending through one of second through-holes 137A and one of through-holes 151 into compartment 133 of door 116, aligning pivot hole 25 of first bracket 20A with first through-hole 135A of door 116 (FIG. 3). Thus, pivotal portion 44 of first transmission member 40A outside of second surface 24 of first bracket 20A is received in first through-hole 135A of door 116. Second end 115 of first spindle 111A extends through first through-hole 135A of first side 117 of door 116 and engages with follower 171 of latch device 12.

Next, second surface 24 of second bracket 20B abuts second side 119 of door 116, with each first hole 511 of second bracket 20B aligned with one of fourth through-holes 137B of door 116. Pivotal portion 44 of second transmission member 40B is received in third through-hole 135B of door 116. Second end 115 of second spindle 111B extends through third through-hole 135B of second side 119 of door 116 and engages with follower 171 of latch device 12.

Each bolt 141 extends through one of first through-holes 151 of second bracket 20B and one of fourth through-holes 137B of door 116 and engages with the screw hole in one of engaging rods 86 (FIG. 8). Since fixing portion 93 of each engaging rod 86 is retained in an associated engagement hole 199 of fixing plate 191 and, thus, can not rotate, each bolt 141 can be rotated relative to engaging rod 86 and, thus, be tightened. After tightening bolts 141, head 143 of each bolt 141 presses against first surface 22 of second bracket 20B, and abutment face 94 of each engaging rod 86 presses against first side 193 of fixing plate 191. Thus, first and second operational devices 10A and 10B tightly clamp door 116.

A first cover 96A is fixed by screws to lugs 30 of first bracket 20A. First handle 52A extends beyond first cover 96A through an opening 98 in first cover 96A. A second cover 96B is fixed by screws to lugs 30 of second bracket 20B. Second handle 52B extends beyond second cover 96B through an opening 98 in second cover 96B.

Figure 5:
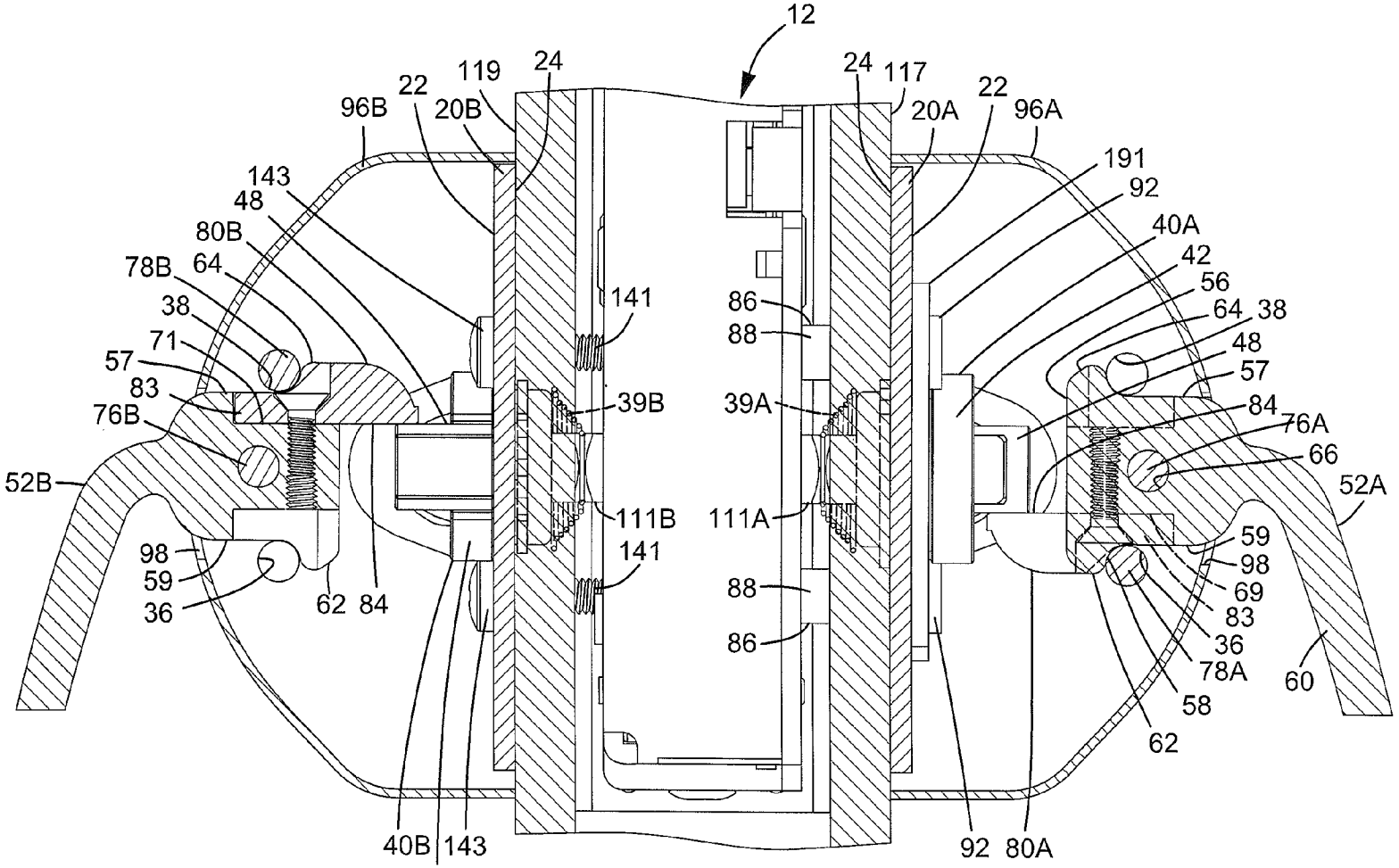
FIG. 5 is a cross sectional view taken along section line 5-5 of FIG. 4.
Figure 6:
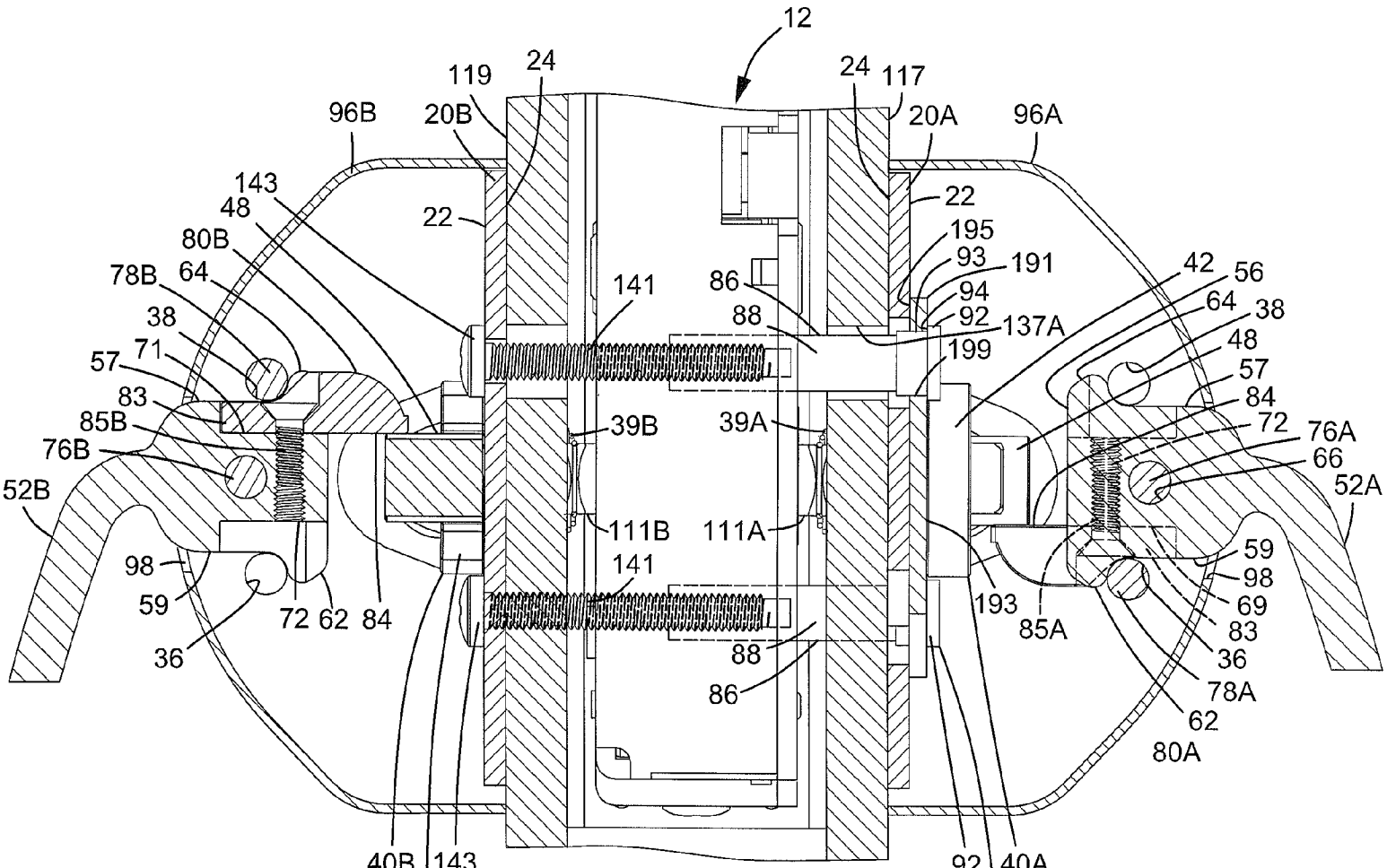
FIG. 6 is a cross sectional view taken along section line 6-6 of FIG. 4.
Figure 7:
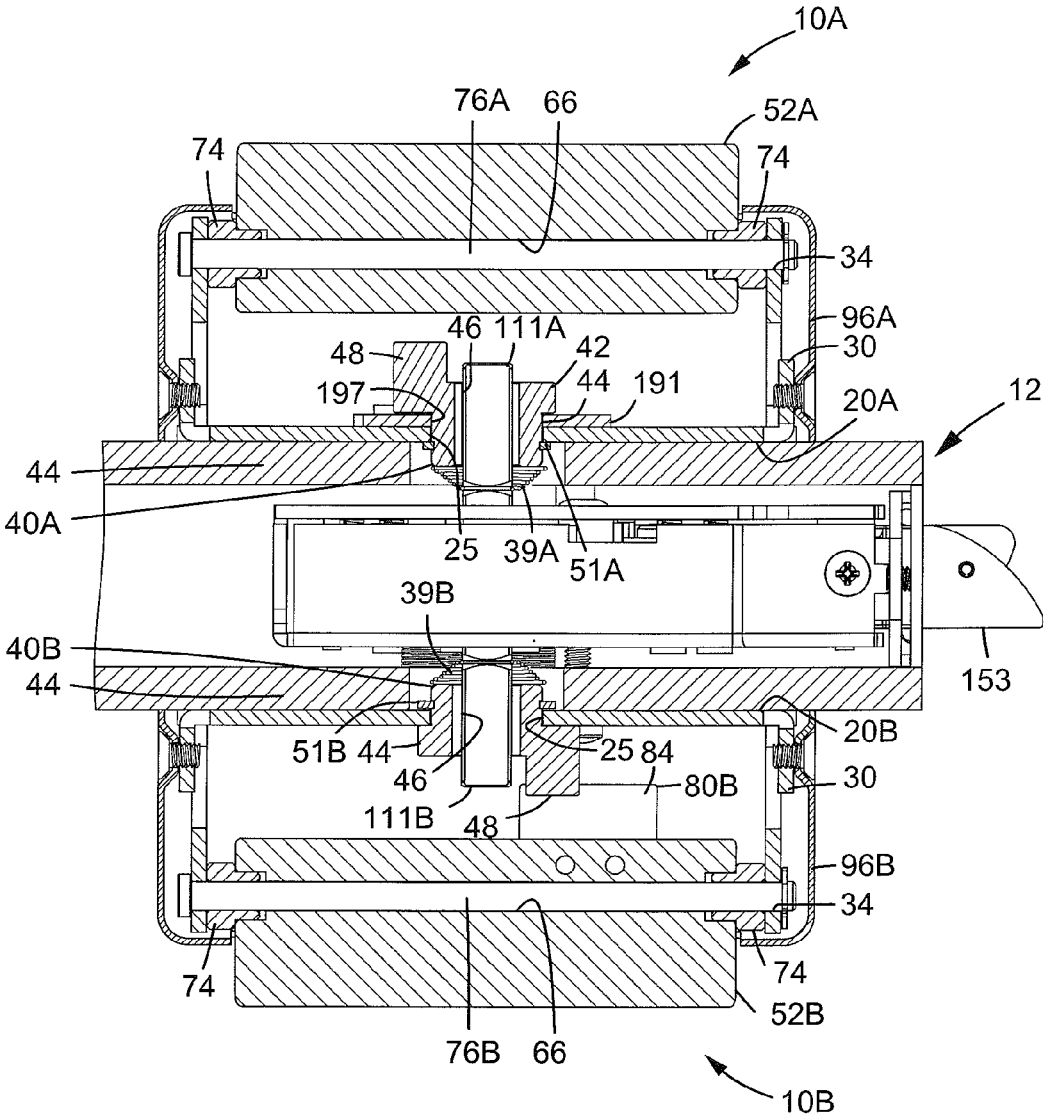
FIG. 7 is a cross sectional view taken along section line 7-7 of FIG. 4.

With reference to FIGS. 3-12, for the sake of explanation, it will be assumed that latch 153 of latch device 12 is in the latching position (FIG. 4), and first and second handles 52A and 52B are in the release position (FIGS. 5 and 6). A user at first side 117 of door 116 can open door 116 by operating first operational device 10A. The user can push first handle 52A to pivot first handle 52A from the releasing position (FIGS. 5 and 6) to the pressing position (FIG. 9), moving first actuating block 80A upward in the vertical direction and pressing against protrusion 48 of first transmission member 40A. First transmission member 40A causes movement of follower 171 and driving board 159, moving latch 153 from the latching position (FIG. 4) to the unlatching position (FIG. 11). Thus, door 116 can be pushed open by keep pushing first handle 52A. After the force imparted to first handle 52A vanishes, a return spring around shank 155 returns latch 153 to the latching position and returns first handle 52A to the release position.

If the user is at second side 119 of door 116, the user can open door 116 by operating second operational device 10B. The user can pull second handle 52B to pivot second handle 52B from the releasing position (FIGS. 5 and 6) to the pressing position (FIG. 10), moving second actuating block 80B downward in the vertical direction and pressing against protrusion 48 of second transmission member 40B. Second transmission member 40B causes movement of follower 171 and driving board 159, moving latch 153 from the latching position (FIG. 4) to the unlatching position (FIG. 11). Thus, door 116 can be pulled open by keep pulling second handle 52B. After the force imparted to second handle 52B vanishes, the return spring around shank 155 returns latch 153 to the latching position and returns second handle 52B to the release position.

Figure 13:
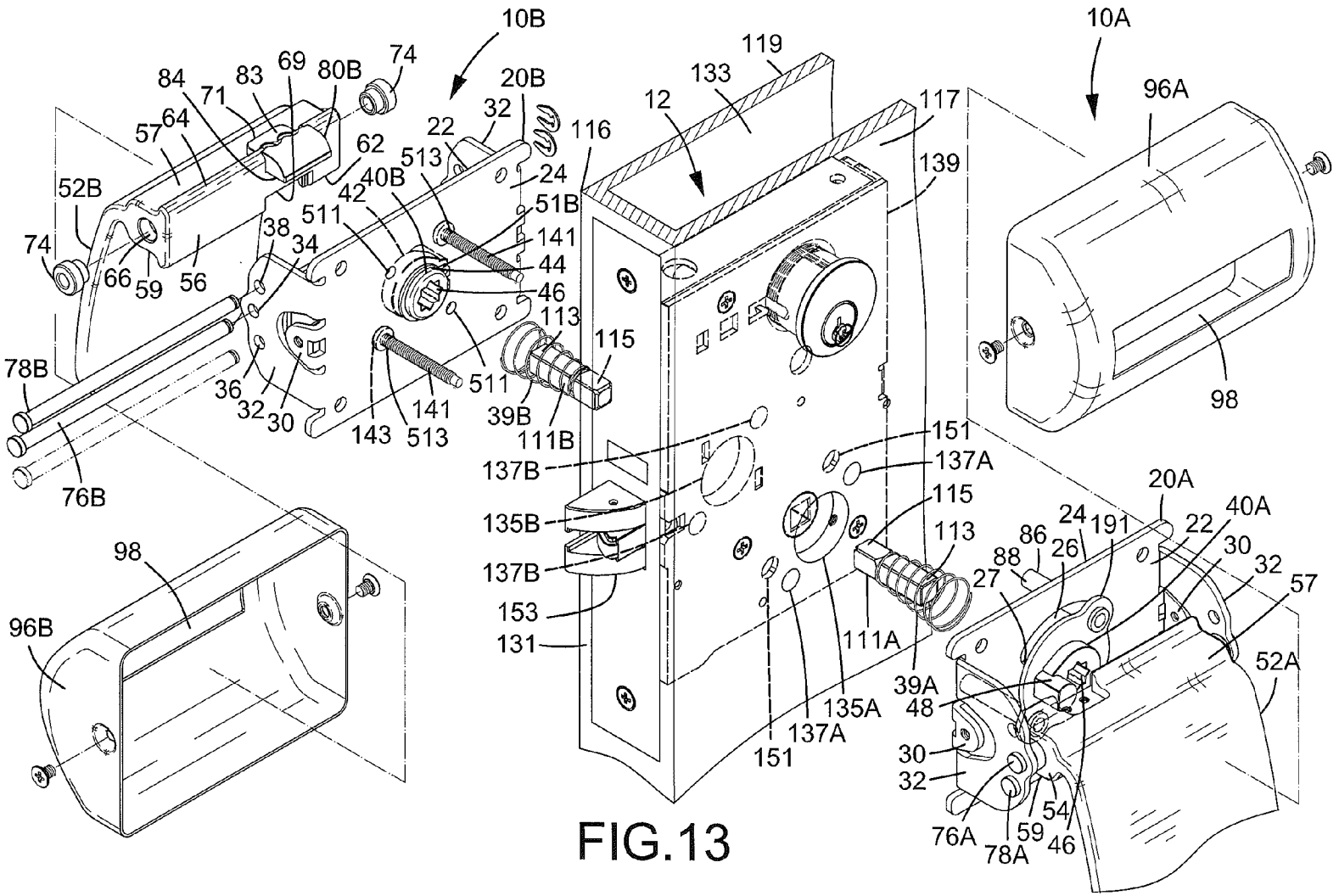
FIG. 13 is an exploded, perspective view of the push/pull operating device, a portion of a door, and a latch device, with a right side of the door adapted to be pivotably connected to a door frame.
Figure 14:
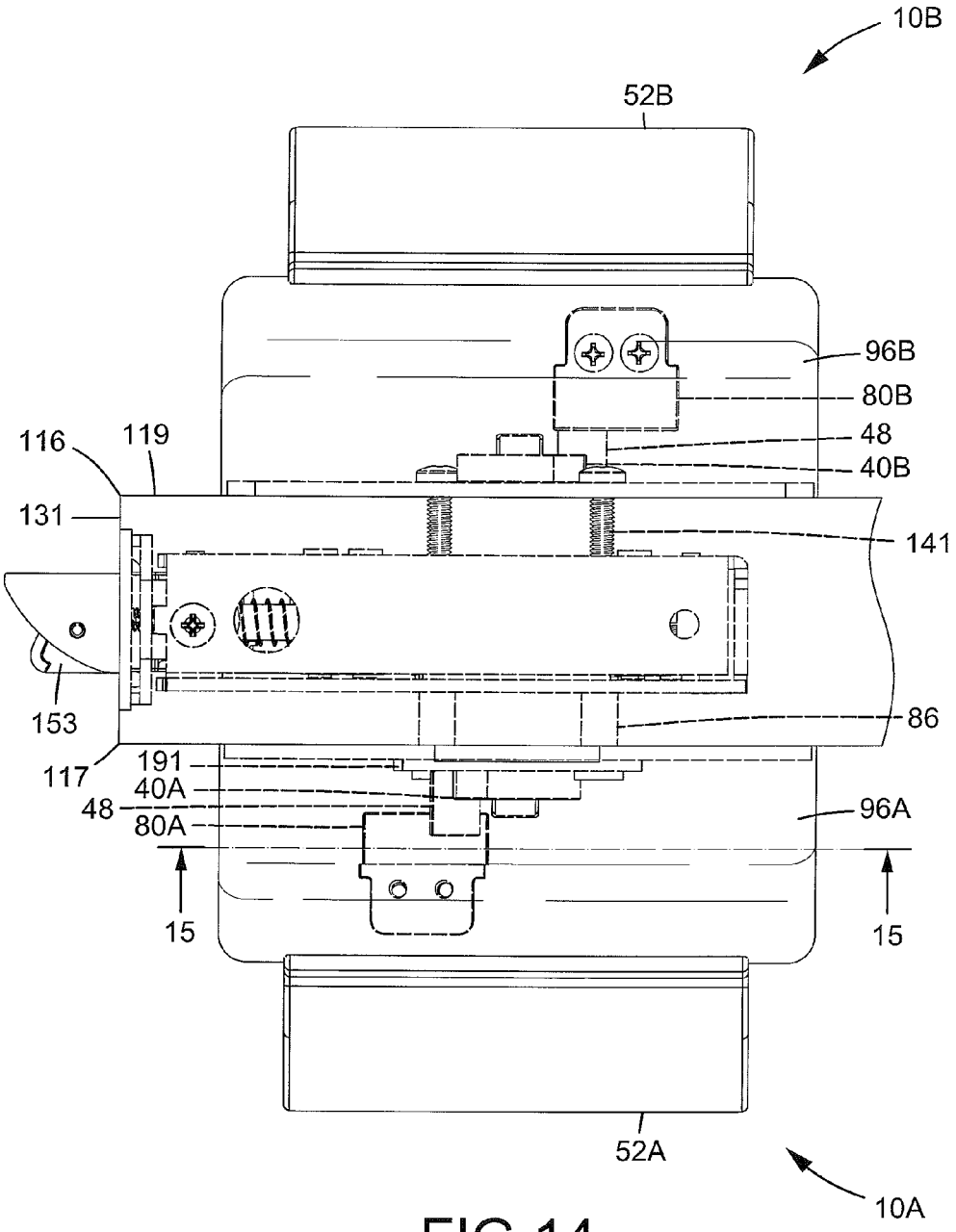
FIG. 14 is a top view of the door, the latch device, and the pull/push operating device of FIG. 13.
Figure 15:
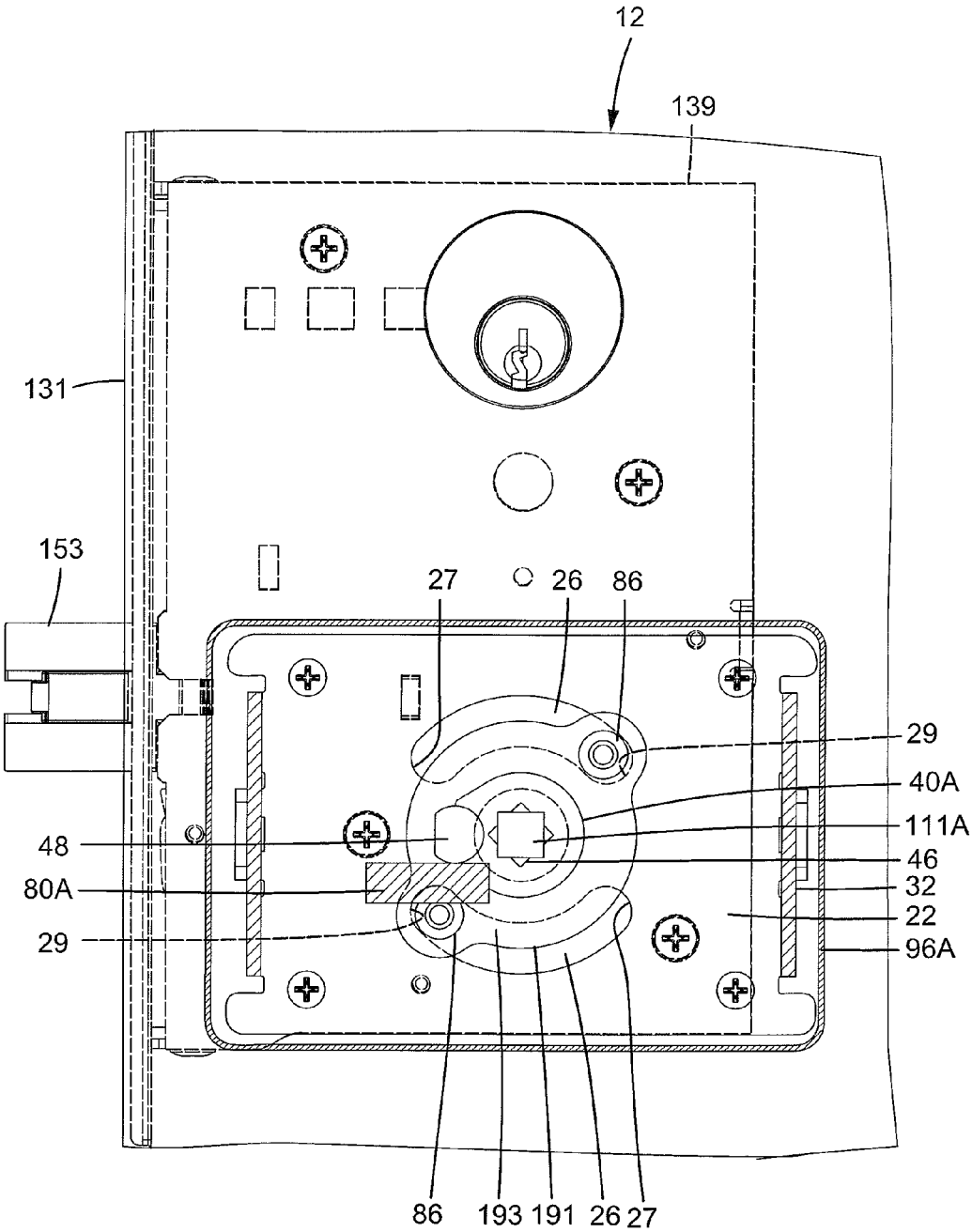
FIG. 15 is a cross sectional view taken along section line 15-15 of FIG. 14.

With reference to FIGS. 13-15, in a case that the right side of door 116 is pivotably connected to a door frame when viewed from first side 117 of door 116. One of through-holes 151 (the left one in FIG. 3) of latch device 12 is below the other through-hole 151 (the right one in FIG. 3). The first cover 96A is detached, and fixing plate 191 of first operational device 10A is pivoted until each engaging rod 86 is in second end 29 of one of slots 26. Thus, each engaging rod 86 can extend from first side 117 through one of second through-holes 137A of door 116 into one of through-holes 151 of latch device 12. Each bolt 141 extends through one of second holes 513 of second bracket 20B into the screw hole in one of engaging rods 86. The first and second covers 96A and 96B are then mounted to finish the installation.

Figure 16:
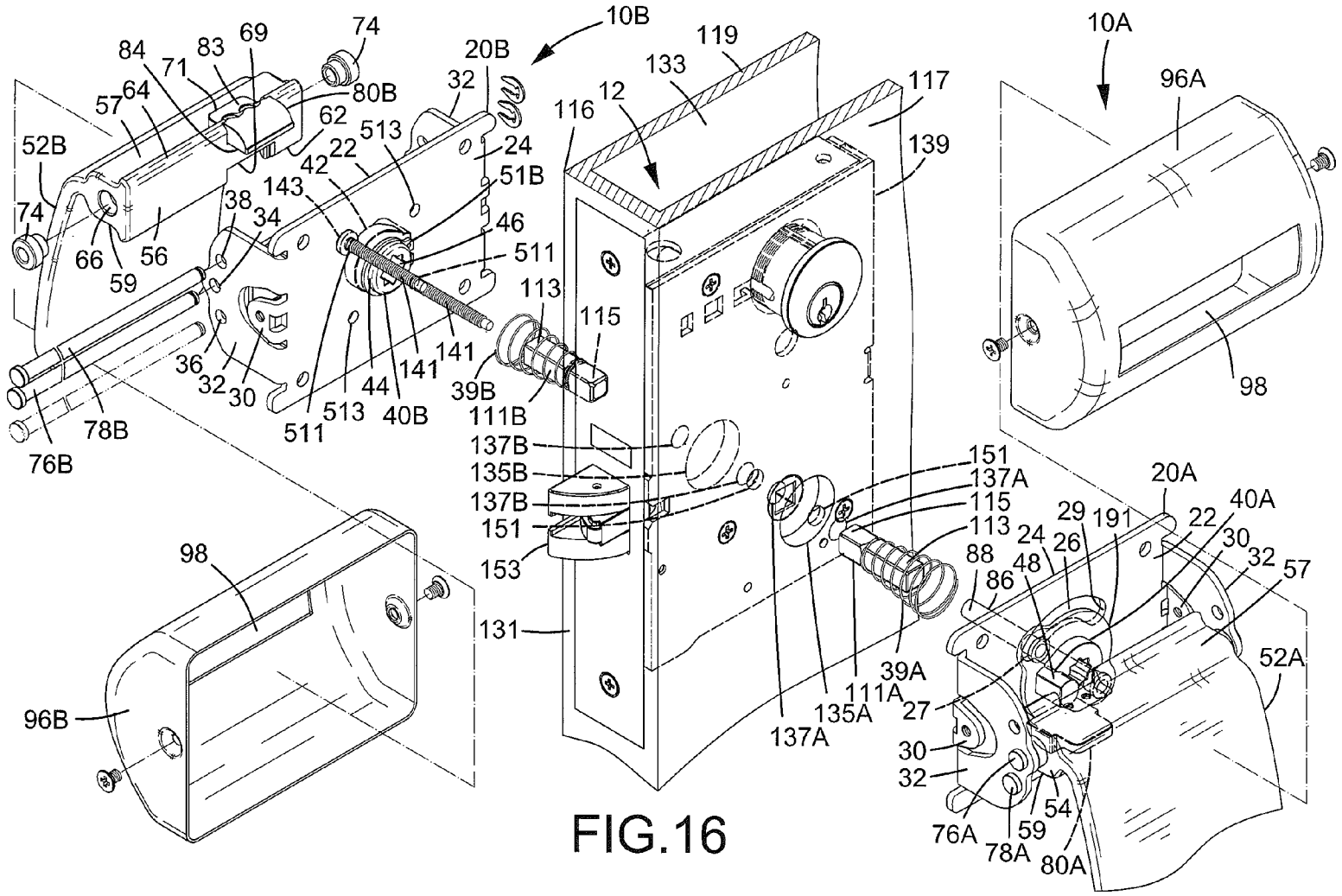
FIG. 16 is an exploded, perspective view of the push/pull operating device, a portion of a door, and a latch device with different through-hole locations, with a right side of the door adapted to be pivotably connected to a door frame.

FIG. 16 shows an embodiment using a latch device 12 other than the type shown in FIGS. 3 and 13. Specifically, in the embodiment shown in FIG. 16, the left through-hole 151 of latch device 12 is located above the right through-hole 151 of latch device 12 due to an arrangement of internal components (c.f. FIG. 13). Thus, when first and second operational devices 10A and 10B are to be mounted to door 116, fixing plate 191 is pivoted until each engaging rod 86 reaches first end 27 of one of slots 26. Thus, each engaging rod 86 can extend through one of second through-holes 137A of door 116 and one of through-holes 151 of latch device 12. Then, each bolt 141 extends through one of first holes 511 of second bracket 20B into the screw hole in one of engaging rods 86. The first and second covers 96A and 96B are then mounted to finish the installation.

It can be appreciated that with first operational device 10A assembled to be of push-open type and with second operational device 10B assembled to be of pull-open type, door 116 is opened if it is moved towards second operational device 10B and is closed if it is moved towards first operational device 10A. Namely, the pivoting direction of first handle 52A from the release position to the pressing position by pushing first handle 52A is the same as the door opening direction, and the pivoting direction of second handle 52B from the release position to the pressing position by pulling second handle 52B is the same as the door opening direction. Thus, door 116 can be opened smoothly.

However, installation of first and second operational devices 10A and 10B can be changed according to the change in the opening direction of door 116. Namely, first operational device 10A can be assembled to be of pull-open type, and second operational device 10B can be assembled to be of push-open type. Specifically, first limiting rods 78A are detached, and first handle 52A can be actuated to pivot first transmission member 40A in a reverse direction until first actuating block 80A and screws 85A are exposed. Then, first limiting rods 78A are extended through second limiting holes 38 of wings 32 of first bracket 20A, and positioning portion 83 of first actuating block 80A is engaged in second positioning groove 71 of first handle 52A such that pressing portion 84 of first actuating block 80A is in a position resting on top of protrusion 48 of first transmission member 40A. Thus, first operational device 10A becomes pull-open type.

Likewise, second limiting rod 78B can be extended through first limiting holes 36 of wings 32 of second bracket 20B, and positioning portion 83 of second actuating block 80B is engaged in first positioning groove 69 of second handle 52B. Pressing portion 84 of second actuating block 80B presses against and is located below protrusion 48 of second transmission member 40B. Thus, second operational device 10B becomes push-open type.

Thus, by directly pivoting fixing plate 191 to adjust the position of engaging rods 86, engaging rods 86 can easily be installed on differently handed doors 116. Furthermore, engaging rods 86 can be used with latch devices 12 having different through-hole 151 locations by simply pivoting fixing plate 191 to change the position of engaging rods 86. Thus, the push/pull operating device according to the present invention can be used with currently available latch devices 12 having different through-hole 151 locations and can easily be installed on differently handed doors 116, allowing easy detachment and assembly.

Furthermore, when it is desired to convert the first or second operational device 10A, 10B between push-open type and pull-open type, the user can simply detach first cover 96A (or second cover 96B) and first limiting rod 78A (or second limiting rod 78B), change the engagement relation between first actuating block 80A (or second actuating block 80B) with first positioning groove 69 or second positioning groove 71, and change the coupling position of first limiting rod 78A (or second limiting rod 78B). First operational device 10A or second operational device 10B does not have to be detached during the conversion, allowing easy on-site conversion according to the actual needs.

Furthermore, first and second operational devices 10A and 10B can be securely fixed to first and second sides 117 and 119 of door 16 by engaging rods 86 and bolts 141 to increase the overall structural strength, reducing the risks of damage to the structural strength resulting from pulling or pushing first handle 52A or second handle 52B.

Now that the basic teachings of the present invention have been explained, many extensions and variations will be obvious to one having ordinary skill in the art. For example, each of first and second handles 52A and 52B can include only one fixing hole 72. First actuating block 80A or second actuating block 80B can be fixed to first positioning groove 69 or second positioning groove 71 by extending a single screw 85A, 85B into fixing hole 72.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A push/pull operating device for driving a latch device, with the push/pull operating device comprising:

a first bracket including first and second surfaces, with the first bracket further including a pivot hole extending from the first surface through the second surface of the first bracket, with the first bracket further including two slots, with the pivot hole of the first bracket located between the two slots, with each of the two slots including a first end and a second end, with the first bracket further including two lateral sides extending between the first and second surfaces of the first bracket, with the first bracket further including a wing formed on each of the two lateral sides of the first bracket, with each wing of the first bracket including an engagement hole, with the first bracket adapted to be mounted to a first side of a door, with the pivot hole of the first bracket adapted to align with a first through-hole in the first side of the door, with the first ends or the second ends of the two slots of the first bracket adapted to align with two second through-holes in the first side of the door;

a first transmission member including a pivotal portion pivotably received in the pivot hole of the first bracket, with the first transmission member further including a flange on an end of the pivotal portion of the first transmission member, with a protrusion formed on the flange of the first transmission member, with a driving hole extending from an end face of the flange through an end face of another end of the pivotal portion of the first transmission member, with the flange of the first transmission member located outside of the first surface of the first bracket, with the pivotal portion of the first transmission member adapted to be received in the first through-hole in the first side of the door;

a fixing plate pivotably connected to the first transmission member, with the fixing plate including a first side and a second side opposite to the first side, with the fixing plate further including a through-hole extending from the first side through the second side, with the fixing plate further including two engagement holes spaced from the through-hole of the fixing plate and aligned with the two slots, with the pivotal portion of the first transmission member pivotably received in the through-hole of the fixing plate, with the fixing plate located between the first surface of the first bracket and the flange of the first transmission member;

a first spindle having first and second ends, with the first end of the first spindle engaged in the driving hole of the first transmission member, with the first spindle and the first transmission member jointly pivotable, with the second end of the first spindle adapted to extend through the first through-hole of the door and adapted to be coupled to a follower of a latch device mounted in the door, with the latch device including a latch operatively coupled to the follower and movable between a latching position outside the door and an unlatching position inside the door;

a first axle pivotably received in the engagement holes of the wings of the first bracket;

a first handle pivotably connected to the first axle, with the first handle including a base and an arm extending from the base, with the first handle pivotable about a pivot axis defined by the first axle between a release position and a pressing position;

a first actuating block detachably mounted to the base of the first handle, with the first actuating block abutting the protrusion of the first transmission member, with the first actuating block pressing against and pivoting the first transmission member when the first handle pivots from the release position to the pressing position;

a second bracket including first and second surfaces, with the second bracket further including a pivot hole extending from the first surface through the second surface of the second bracket, with the second bracket further including two first holes and two second holes around the pivot hole of the second bracket, with the first holes diametrically opposed to each other in a diameter direction of the pivot hole of the second bracket, with the two second holes diametrically opposed to each other in a diameter direction of the pivot hole of the second bracket, with the second bracket further including two lateral sides extending between the first and second surfaces of the second bracket, with the second bracket further including a wing formed on each of the two lateral sides of the second bracket, with each wing of the second bracket including an engagement hole, with the second bracket adapted to be mounted to a second side of the door opposite to the first side of the door, with the pivot hole of the second bracket adapted to align with a third through-hole in the second side of the door, with each of the two first holes or each of the two second holes of the second bracket adapted to align with one of two fourth through-holes in the second side of the door, with the two fourth through-holes of the door adapted to align with two through-holes of the latch device;

a second transmission member including a pivotal portion pivotably received in the pivot hole of the second bracket, with the second transmission member further including a flange on an end of the pivotal portion of the second transmission member, with a protrusion formed on the flange of the second transmission member, with a driving hole extending from an end face of the flange through an end face of another end of the pivotal portion of the second transmission member, with the flange of the second transmission member located outside of the first surface of the second bracket, with the pivotal portion of the second transmission member adapted to be received in the third through-hole in the second side of the door;

a second spindle having first and second ends, with the first end of the second spindle engaged in the driving hole of the second transmission member, with the second spindle and the second transmission member jointly pivotable, with the second end of the second spindle adapted to extend through the third through-hole of the door and adapted to be coupled to the follower of the latch device;

a second axle pivotably received in the engagement holes of the wings of the second bracket;

a second handle pivotably mounted to the second axle, with the second handle including a base and an arm extending from the base of the second handle, with the second handle pivotable about a pivot axis defined by the second axle between a release position and a pressing position;

a second actuating block detachably mounted to the base of the second handle, with the second actuating block abutting the protrusion of the second transmission member, with the second actuating block pressing against and pivoting the second transmission member when the second handle pivots from the release position to the pressing position;

two engaging rods, with each of the two engaging rods securely positioned and non-rotatably engaged in one of the two engagement holes of the fixing plate, with each of the two engaging rods including a body extending through one of the two slots of the first bracket, wherein when the fixing plate pivots, each of the two engaging rods moves between the first and second ends of one of the two slots of the first bracket, and wherein when each of the two engaging rods is aligned with the first end or the second end of one of the two slots of the first bracket, the bodies of the two engaging rods are adapted to extend through the two second through-holes in the first side of the door and are adapted to extend through the two through-holes of the latch device; and two bolts engaged with the two engaging rods, with each of the two, bolts including a head abutting the first surface of the second bracket with the two bolts extending through the first holes or the second holes of the second bracket, with the two bolts adapted to extend through the two fourth through-holes in the second side of the door and the two through-holes of the latch device to engage with the two engaging rods, wherein when each of the two engaging rods is in the first end of one of the two slots of the first bracket, each of the two engaging rods is aligned with one of the two first holes of the second bracket, and wherein when each of the two engaging rods is in the second end of one of the two slots of the first bracket, each of the two engaging rods is aligned with one of the two second holes of the second bracket.

2. The push/pull operating device as claimed in claim 1, with each of the wings of the first bracket further including a first limiting hole located below the engagement hole of the first bracket in a vertical direction and a second limiting hole located above the engagement hole of the first bracket in the vertical direction, with each of the wings of the second bracket further including a first limiting hole located below the engagement hole of the second bracket in the vertical direction and a second limiting hole located above the engagement hole of the second bracket in the vertical direction, with the push/pull operating device further comprising:

a first limiting rod mounted in the first limiting holes of the first bracket or the second limiting holes of the first bracket; and a second limiting rod mounted in the first limiting holes of the second bracket or the second limiting holes of the second bracket, with the base of each of the first and second handles including an upper face, a lower face, and an inner face extending between the upper face and the lower face, wherein when the first handle is in the release position, the lower face of the base of the first handle abuts the first limiting rod, and wherein when the second handle is in the release position, the upper face of the base of the second handle abuts the first limiting rod.

3. The push/pull operating device as claimed in claim 2, with the first handle further including a first positioning groove in the lower face of the first handle and a second positioning groove in the upper face of the first handle, with the first handle further including a fixing hole extending from a bottom wall of the first positioning groove of the first handle through a bottom wall of the second positioning groove of the first handle, with the first actuating block including a positioning portion and a pressing portion, with a first screw extending through the first actuating block into the fixing hole of the first handle, with the positioning portion of the first actuating block engaged in one of the first and second positioning grooves of the first handle, with the second handle further including a first positioning groove in the lower face of the second handle and a second positioning groove in the upper face of the second handle, with the second handle further including a fixing hole extending from a bottom wall of the first positioning groove of the second handle through a bottom wall of the second positioning groove of the second handle, with the second actuating block including a positioning portion and a pressing portion, with a second screw extending through the second actuating block into the fixing hole of the second handle, with the positioning portion of the second actuating block engaged in one of the first and second positioning grooves of the second handle, wherein when the positioning portion of the first actuating block is engaged in the first positioning groove of the first handle and if the first limiting rod is engaged in the first limiting holes of the first bracket, the pressing portion of the first actuating block is located below and abuts the protrusion of the first transmission member in a vertical direction, and the arm of the first handle pivots towards the first surface of the first bracket when the first handle pivots from the release position to the pressing position, wherein when the positioning portion of the first actuating block is engaged in the second positioning groove of the first handle and if the first limiting rod is engaged in the second limiting holes of the first bracket, the pressing portion of the first actuating block is located above and abuts the protrusion of the first transmission member in the vertical direction, and the arm of the first handle pivots away from the first surface of the first bracket when the first handle pivots from the release position to the pressing position, wherein when the positioning portion of the second actuating block is engaged in the first positioning groove of the second handle and if the second limiting rod is engaged in the first limiting holes of the second bracket, the pressing portion of the second actuating block is located below and abuts the protrusion of the second transmission member in the vertical direction, and the arm of the second handle pivots towards the first surface of the second bracket when the second handle pivots from the release position to the pressing position, and wherein when the positioning portion of the second actuating block is engaged in the second positioning groove of the second handle and if the second limiting rod is engaged in the second limiting holes of the second bracket, the pressing portion of the second actuating block is located above and abuts the protrusion of the second transmission member in the vertical direction, and the arm of the second handle pivots away from the first surface of the second bracket when the second handle pivots from the release position to the pressing position.

* * * * *